United States Patent [19]

DeRossett

[11] 4,197,940

[45] Apr. 15, 1980

[54] CIRCULAR CAKE TRAY AND COVER

[75] Inventor: Fred M. DeRossett, Huntington Beach, Calif.

[73] Assignee: Sunrich Mercantile Corp., LaHabra, Calif.

[21] Appl. No.: 30,024

[22] Filed: Apr. 16, 1979

[51] Int. Cl.[2] ..... B65D 25/02; B65D 85/36

[52] U.S. Cl. ..... 206/45.32; 150/0.5; 220/306; 220/403; 220/405; 229/2.5 R; 312/284

[58] Field of Search ..... 206/45.32, 459; 150/0.5; 220/94 A, 400, 405, 410, 408, 306, 403; 312/284; 229/2.5 R

[56] References Cited

U.S. PATENT DOCUMENTS

| | | | |
|---|---|---|---|
| 1,762,417 | 6/1930 | Pfefferkorn | 312/284 |
| 1,863,793 | 6/1932 | Hermani | 220/94 A |
| 2,246,695 | 6/1941 | Phillips | 206/45.32 |
| 3,066,824 | 12/1962 | Bostrom | 220/306 |
| 3,101,864 | 8/1963 | Glickman | 220/405 |
| 3,303,964 | 2/1967 | Luker | 229/2.5 |
| 3,511,288 | 5/1970 | Swett et al. | 312/284 |
| 3,915,532 | 10/1975 | Ashton | 220/400 |
| 4,105,121 | 8/1978 | Mascetti | 206/459 |
| 4,147,277 | 4/1979 | Bateman et al. | 220/400 |

*Primary Examiner*—William T. Dixson, Jr.
*Attorney, Agent, or Firm*—Knobbe, Martens, Olson, Hubbard & Bear

[57] ABSTRACT

A circular cake tray and cover contains a cake mounted on a plate. The cake is prevented from sliding within the container by means of matching surface features on the tray and on the cake plate which mutually nest to lock the plate into place on top of the tray. The depth of the surface features is sufficient to prevent movement of the plate with respect to the tray even when the tray is tilted to a substantial angle, thereby reducing the likelihood that the cake plate would slide when the container is tilted and damage the cake by impact with the cover. The tray and cover are removably fastened together with a continuous outer flange on the circumference of the cover resiliently latched beneath a plurality of horizontal flanges which are disposed along the edge of the tray in such a manner that the cover may be easily latched or removed from the tray without regard to the rotational orientation of the cover with respect to the tray.

13 Claims, 5 Drawing Figures

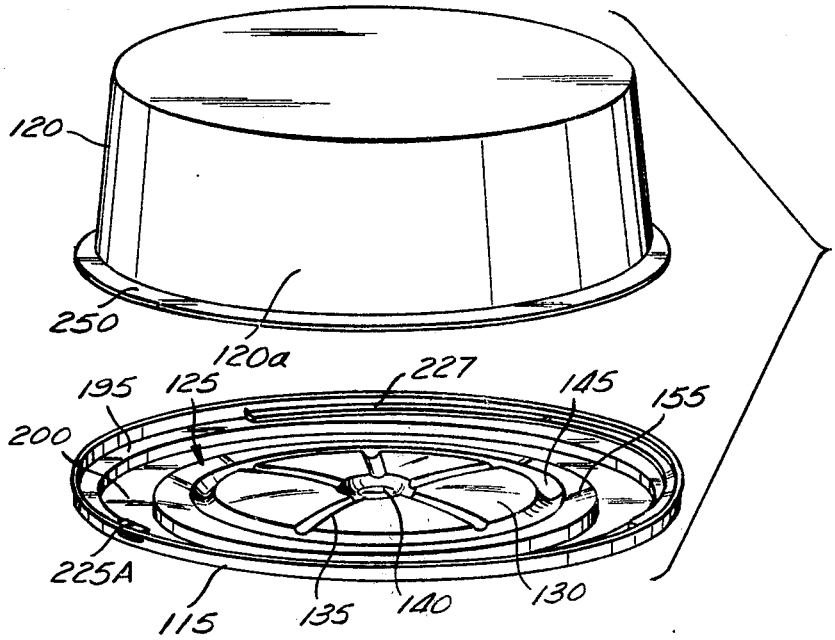
Fig. 3
Fig. 1
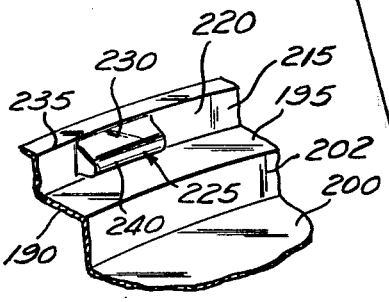
Fig. 5
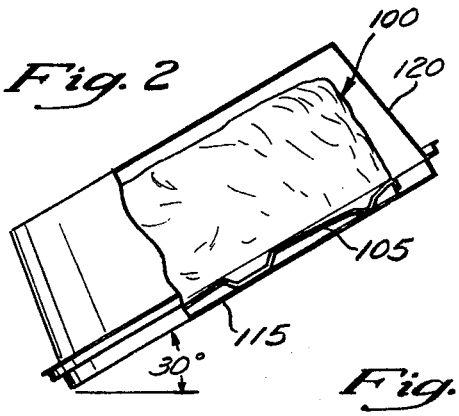
Fig. 2
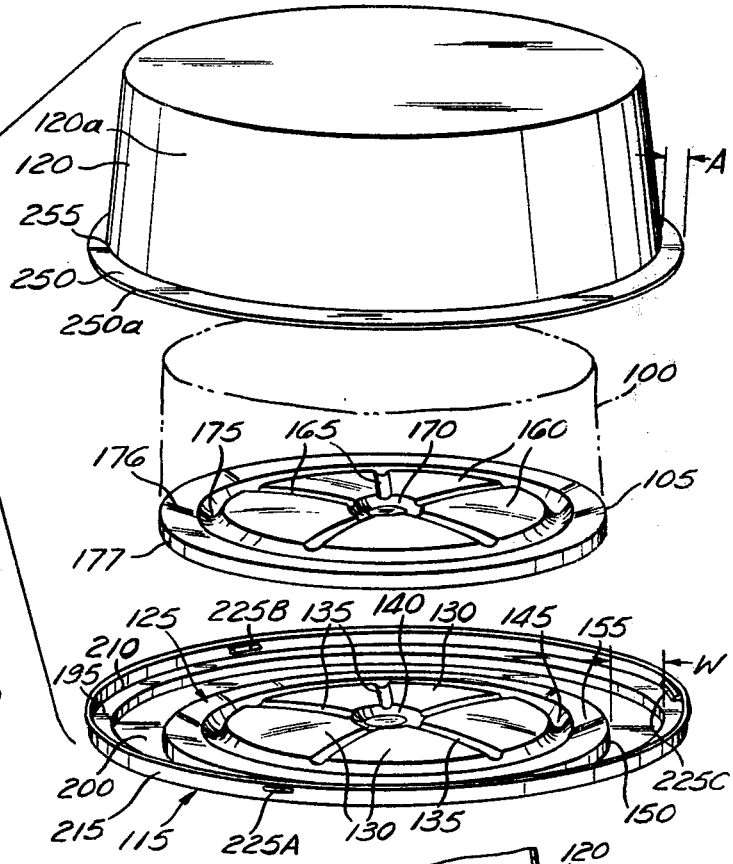
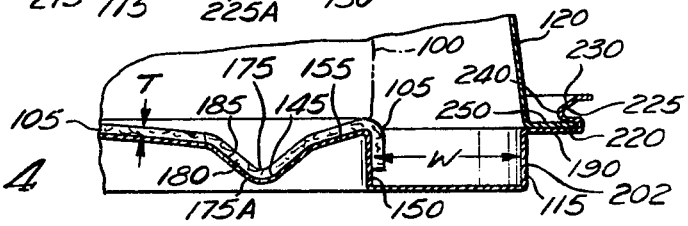
Fig. 4

CIRCULAR CAKE TRAY AND COVER

BACKGROUND OF THE INVENTION

Cakes and pastries generally sold in supermarkets typically have containers effectively covering the entire pastry in order to protect the pastry from contamination and loss of moisture between the time that it is baked and the time that a customer finally purchases the cake. The cake or pastry is typically mounted on a paper or fiber plate as it is prepared, and, just prior to shipment, it is placed in the container, usually a cardboard box. The paper plate supporting the cake readily slides within the container whenever the container is tipped, as it may very well be during shipment and handling of the container. The resulting impact between the cake and the inner edges of the container is often sufficient to distort the shape of the cake, making it less appealing to the consumer, such that it must therefore be sold at a loss or completely discarded. As a result, movement of the cake or pastry within its container is a common occurrence during handling and shipment, and causes a significant loss of profit in food markets.

Plastic cake trays and covers are currently used as containers for cakes. A common disadvantage of current pastry and cake containers is that the means for closing and fastening such containers is usually either elaborate and costly to fabricate or, in less costly versions, can be re-fastened only after a significant amount of manipulation by the consumer. For example, in one fastening scheme typical of the less costly versions, a cover can only be fastened to its tray after it has been turned to a particular rotational position. This requires the user to rotate the cover and to ascertain the correct position for fastening. Therefore, a need exists for a fastening means between pastry trays and covers which require little or no inconvenient manipulation by the user.

SUMMARY OF THE INVENTION

The foregoing problems are solved in the present invention which includes an integrally formed, thin, circular cake tray to which a closed, cylindrical cover may be releasably fastened. A cake or pastry is mounted on a plate and placed on top of the tray and is then covered with the cover. The tray and plate are formed with mutually registering means so that when the tray is tipped, the cake plate is held in place by virtue of the nesting surface features of the tray and of the cake plate.

In a preferred arrangement the tray is formed with an elevated circular inner portion for mounting the cake plate. The circular inner portion has surface features, including radially disposed lands and grooves, which nest into identical surface features formed on the cake plate. These lands and grooves converge in the center of the tray at a circular recess. The elevated central portion also includes an annular groove near its edge circumference, and the radially extending lands and grooves are terminated at this groove. The cake plate has about the same diameter as the circular elevated central portion and is supported on this portion.

Means are provided on the cake tray for releasably fastening a cylindrical cover in any rotational orientation. For this purpose, a vertically extending outer flange is located along the outer circumference of the circular tray. A plurality of integrally formed horizontal tabs are disposed to extend radially inwardly on the inner surface of the vertical flange. A complementary feature is provided on the bottom edge of the cylindrical cake cover including a horizontal, radially outwardly extending annular flange integrally formed with the bottom edge of the cover, which flange may be latched beneath the plurality of the horizontal tabs on the tray. In order to facilitate the latching process, the cake cover is formed of a somewhat flexible and resiliently deformable material. Each tab has a top surface which is ramped downwardly from the top edge of the vertically extending outer flange of the tray to the radially inward edge of the tab. To position the cover on the tray the cover flange is slipped edgewise beneath one or two of the tabs, and the cover side wall adjacent the cover flange and the third tab is pressed inwardly and down onto the tray so that the cover flange and the horizontal tab are mutually deformed in that area to allow the flange to slide along the tab ramped surface until the flange resiliently snaps back under the tab. The horizontal flange on the cover extends around the entire circumference of the cover so that the cover is easily latched to the tray without regard to its rotational orientation. The spacing of the tabs is selected so that when the cover is latched, it will not inadvertently become unlatched. In a preferred embodiment of the invention, three inwardly extending horizontal tabs are provided on the radially inner surface of the vertical flange in order to receive the outwardly extending annular flange on the cover, and these tabs are spaced at equal intervals along the circumference of the tray.

LIST OF FIGURES

The invention is best understood with reference to the drawings of which:

FIG. 1 is an exploded perspective view of the cake container assembly of this invention, including a cake tray, a cake plate, and a cake cover;

FIG. 2 is a cutaway side view of the cake container assembly of FIG. 1 fully assembled, with the orientation of the container assembly tilted with respect to the normal horizontal orientation;

FIG. 3 is a perspective view of the container assembly of this invention using an alternative embodiment cake tray;

FIG. 4 is a cutaway cross-sectional view of a portion of the cake container assembly of this invention clearly showing the mutually nesting surface features of the cake plate and the cake tray of this invention; and FIG. 5 is an enlarged partial perspective view of the container tray of FIG. 1 showing the fastening means on the tray.

DETAILED DESCRIPTION OF THE INVENTION

FIG. 1 shows the pastry container assembly of this invention in an exploded perspective view. A cake 100 shown in phantom lines rests on a cake plate 105. The plate 105, in turn, is mounted on a cake tray 115. A cover 120 is placed over the cake tray 115 to protect the cake against moisture loss and contamination. The cake tray 115 is an integrally formed thin discoid having a nearly uniform thickness throughout so that its top and bottom surfaces have congruent shapes.

The tray 115 is integrally formed with an elevated inner central portion 125 having a diameter and surface terrain matching the diameter and surface terrain of the cake plate 105. The circular elevated or upwardly projecting portion 125 includes five arcuately convex lands 130, which define five arcuately concave, radially extending grooves 135 disposed between adjacent lands. Each of the lands are somewhat pie-shaped, or more technically might be said to form approximately a section of a prolate spheroid. The lands and grooves centrally converge in a somewhat cylindrical recess 140 at the center of the circular elevated portion 125. An annular groove 145 of arcuately convex cross-sectional shape is provided near the circumferential edge 150 of the elevated central portion 125, marking the outer ends of the lands 130 and the grooves 135. A radially sloping annular planar surface 155 is defined between the annular groove 145 and a depending circumferential flange 150 forming the edge of the elevated portion 125.

FIG. 1 shows that the cake plate 105 is formed with a similar terrain on its top surface, including five radially extending lands 160 defining five grooves 165 extending radially outward between adjacent lands 160 from a central recess 170. The lands 160 and the grooves 165 are radially terminated in an intermediate annular groove 175. An annular planar surface 176 surrounds the groove 175 and is about equal in width to the surface 155 on the tray. The diameter of the cake plate 105 about equals the diameter of the elevated central portion 125 of the tray, and may terminate in a depending, circumferential lip 177.

The thickness T of the thin cake plate 105 between its top and bottom surfaces is uniform throughout the cake plate 105. Therefore, the terrain of the bottom surface of the cake plate 105 is congruent with the top surface of the plate 105, while the lands 160 and grooves 165 of the plate 105 conform with the lands 130 and grooves 135 of the tray 115. As a result, the terrain of the bottom surface of the plate 105, including the lands and grooves 160,165, nests or registers vertically within the lands and grooves 130,135 of the tray 115. Consequently, if the tray 115 is tilted, the nesting of the lands and grooves of the plate 105 and tray 115 opposes relative movement between the plate 105 and the tray 115. Furthermore, the lands 160 and grooves 165 in the top surface of the plate 105 oppose relative movement between the cake 100 and the plate 105, inasmuch as the bottom of the cake will conform to the terrain of the plate 105 if it is prepared on the plate 105 or rests on the plate for a period of time. Therefore, a collision between the cake 100 and the sidewalls of the cover 120 is prevented by the nesting features between the plate 105 and the tray 115. This function is best seen by reference to FIGS. 2 and 4. FIG. 2 shows a cutaway view of the assembled cake container which has been tilted, and shows the nesting features resisting movement of the cake plate 105 toward the sidewalls of the cylindrical cover 120. The cross-sectional view of FIG. 4 shows the annulus 175A in the bottom surface of the cake plate 105, corresponding to the annular groove 175 in its top surface, nesting in the annular groove 145 in the top surface of the tray 115. As one example of the interengaging surfaces, angular surface 180 on the annulus 175A and angular surface 185 on the groove 145 engage and thereby oppose relative movement between the plate 105 and the tray 115 when the container assembly is tilted as shown in FIG. 2. In this embodiment of the invention, the tray 115 may be tilted about 30° without causing the cake 100 to move or impact the cover 120.

The lip 177 of the plate also helps prevent lateral shifting of the plate relative to the tray. However, this lip does tend to interfere somewhat with positioning the plate and cake on the tray, and hence can be eliminated if desired.

It has been recognized that the plate 105 may be prevented from moving on the tray 115 by any suitable variations of the foregoing features, including any structural features in the plate bottom which are vertically registered with structural features in the tray top without necessarily conforming.

The tray 115 and cover 120 are provided with means for fastening the cover 120 onto the tray 115 which are independent of the axial rotational orientation of the cover 120 with respect to the circular tray 115. The tray 115 includes an outer annular elevated portion 190 having a flat horizontal wall 195. An intermediate annular recessed portion or groove 200 is defined between the elevated outer portion 190 and the elevated inner portion 125. More specifically, the groove 200 is formed by the vertical flanges 150 and 202, and the horizontal annular wall 204, FIG. 4. A vertically extending circumferential flange 215 is disposed at outer circumference 210 of the outer annular elevated portion 190. The inner surface 220 of the vertical flange 215 is formed with three radially inward horizontally extending tabs 225A, B, and C, that are preferably equally spaced and extend circumferentially less than 15°. The features of each tab 225 are best shown in FIG. 5. The tabs 225 each have a top surface 230 which is downwardly ramped continuously from top edge 235 of the flange 215 to radially inward edge 240 of each of the tabs 225. As best seen by reference to FIG. 4, the top surface 230 merges arcuately into the radial edge 240 so that the radial edge 240 is rounded from top to bottom and continues radially outwardly in a flat horizontal bottom surface to the inner face 220 of the vertical flange 215. The foregoing structural features of the tray 115 are of sufficiently elementary and simple configurations so that the tray 115 may be integrally formed in a one-step molding process. The horizontal tabs 225 comprise the fastening means formed on the tray 115.

The fastening means formed on the cover 120 include a radially outwardly extending annular flange 250 integrally formed with the generally cylindrical but tapered dome of the cover 120 and extending outwardly from bottom circumferential edge 255 of the dome. As seen from FIG. 4, the diameter of the edge 255 is approximately equal to the diameter of the circumferential vertical flange 202, and the width A of the cover flange 250 is about equal to the width of the wall 195. The radial length of each tab 225 is about equal to a $\frac{1}{3}$ or $\frac{1}{2}$ the width of the wall 195. Therefore, the annular cover flange 250 may be latched under the three tabs 225 to rest on the wall 195.

The simple configuration of the latching flange 250 on the cover 120 and the latching tabs 225 on the tray 115 facilitates the integral formation of the tray 115 and cover 120 by a one-step molding process. The tray 115 and cover 120 are preferably formed from a somewhat resiliently deformable light, thin plastic. The resiliently deformable nature of the plastic material of the cover 120 permits the tray 115 and cover 120 to be latched together and to be separated by the consumer many times so that the usefulness of the invention lasts for a significant period of time. Preferably, the cover is molded of oriented polystyrene, having an initial thickness of about 20 mils, which is thinned considerably in the upper part of the cover during the molding process. The tray is preferably molded of high impact polystyrene, with a thickness of about 18 mils.

In installing the cover, the annular flange 250 is inserted edgewise beneath two of the tabs 225; and the cover side wall adjacent the cover flange and the third tab is temporarily deformed inwardly and downwardly against the tab ramp a slight amount which causes the cover wall 120*a* to deform radially inwardly a slight amount adjacent the third tab to allow the remainder of the cover flange to snap beneath the third tab. The tab and tray also deform outwardly a slight amount when the cover flange is being pressed into position. While closing the cover, it is helpful to grip the tray by the outwardly extending horizontal flange formed at the upper end of the vertical flange 215. When released, the components return to their undeformed configuration.

When the cover is to be removed, it is only necessary to depress the tray flange 215 adjacent one of the flanges to temporarily deform the flange and allow the cover flange to pop above that tab. The cover flange can be removed from beneath the other two tabs as the cover is being lifted off the tray.

One advantageous feature of the invention is that the cover supporting means on the tray 115, namely, the annular elevated portion 190, is separated by the width W of the intermediate annular groove 200 from the circular elevated plate support portion 125. Thus, the cake is not engaged by the cover during the opening and closing operations, wherein the cover is temporarily deformed and raised and lowered. Further, the width W of the groove 200 is sufficient so that when a downward force is exerted on the vertical flange 215, the annular elevated portion 190, and the annular recessed portion 200 they may be elastically deformed to absorb the force, so that the plate support portion 125 remains free from deformation. Thus, the cake plate 105 and the cake 100 remain undisturbed.

FIG. 3 illustrates an alternative embodiment of the tray 115 of this invention in which two of the tabs 225B, 225C are replaced by an elongate flange 227 having the same cross-sectional configuration as each tab 225 but extending circumferentially around approximately 120° of the circumference of the tray 115. In order to latch the cover flange 250 beneath the elongate flange 227, the cover 120 is tilted at an angle and the cover flange 250 is slipped beneath the elongate flange 227 without deforming the cover 120. Then the cover flange 250 is pressed down and in on the tab 225A, causing the adjacent portion of the cover wall 120 to deform radially inwardly to allow the cover flange 250 to snap beneath the tab 225A. The presence of the elongate flange 227 reduces the possibility of the cover 120 to becoming inadvertently unlatched from the tray since the opening deformation force would have to be rather precisely adjacent the tab 225A.

In the embodiments illustrated in FIGS. 1 and 3, the cover 120 is quickly latched to the tray 115 without regard to the rotational orientation of the cylindrical cover 120 because the outer flange 250 extends around the entire circumference of the bottom edge 255 of the cover 120. Therefore, the user is not forced to inconveniently rotate the cover 120 to a particular position on the tray 115 in order to latch or unlatch the cover. Furthermore, the tabs 225 in the embodiment illustrated in FIG. 1 and the elongated flange 227 in the embodiment illustrated in FIG. 3 are symmetrically arranged along the circumference of the tray 115 so that the flange 250 cannot slip out from under the fastening means 225, 227 without deformation of the components.

I claim:

1. A pastry container comprising a tray and a cover holding a pastry mounted on a pastry plate:

the bottom surface of said plate resting on a plate supporting portion of the top surface of said tray;

said cover mounted on said tray over said plate and resting on a cover supporting portion of the top surface of said tray; and said tray and said plate each integrally formed to mutually comprise elevated and recessed portions in said surfaces, said matching portions congruently nested between said plate and said tray, elevated portions in said top surface of said tray nested in recessed portions in said bottom surface of said plate and depending portions in said bottom surface of said plate nested in recessed portions in said top surface of said tray, so that said plate is constrained from transversely sliding on said tray even when said tray is moderately inclined.

2. A pastry container as defined in claim 1 further comprising:

resiliently deformable fastening means integrally formed in said tray and said cover for releasably latching said cover onto said tray independently of the rotational orientation of said cover with respect to said tray.

3. A pastry container as defined in claim 2 wherein said fastening means comprises:

a vertical flange on the outer circumference of said tray having a plurality of horizontally extending members formed therein;

a horizontal annular flange on the bottom circumferential edge of said cover releasably latched under said horizontal members, said horizontal flange extending continuously around the entire edge of said cover so that said flange may be latched beneath said horizontal members independently of the rotational orientation of said cover; and said horizontal members spaced along said vertical flange so that said horizontal flange cannot inadvertently become unlatched.

4. A pastry container as defined in claim 3 wherein said plurality of horizontal members are spaced along equal intervals.

5. A pastry container as defined in claim 3 wherein said tray further comprises an annular groove separating said cover supporting portion from said plate supporting portion of said tray, and having sufficient width so that cover opening and closing operations do not interfere with a cake supported on plate and said plate supporting portion.

6. A pastry container assembly comprising:

a circular thin plate holding a pastry on its top surface, the bottom surface of said plate having elevated and recessed portions formed therein;

an integrally formed thin circular container tray having an elevated central circular portion formed in its top surface supporting said plate, the top surface of said elevated central portion comprising elevated and recessed portions conforming to the elevated and recessed portions of the bottom surface of said plate, the elevated portions in said top surface of said central portion nesting in the recessed portions in the bottom surface of said plate so that said plate is constrained from sliding on said central portion even when said tray is moderately inclined;

said tray further comprising an outer annular elevated portion formed in the top surface of said tray along its outer circumference and extending radially inwardly therefrom, said elevated annular portion surrounding said elevated central portion and defining therebetween an intermediate annular recessed portion surrounding said elevated central portion; and a cylindrical cover axially aligned over said tray, the lower circumferential edge of said cover resting on said outer annular elevated portion.

7. A pastry container assembly as defined in claim 6 further comprising cover fastening means comprising:

a vertical flange integrally formed with said tray on the outer circumferential edge of said outer annular elevated portion and extending vertically therefrom, said flange resiliently deformable;

a plurality of horizontal radially extending tabs integrally formed with said tray on the surface of said vertical flange, each of said tabs comprising:

a ramped top surface extending radially from said vertical flange;

a flat horizontal bottom surface extending radially from said vertical flange; and said top and bottom surfaces meeting together to define a rounded radial edge of said tab;

a horizontal annular flange integrally formed on the bottom circumferential edge of said cover, and extending in an opposite radial direction with respect to said tabs, said horizontal flange releasably latched beneath said tabs and resting on said outer annular elevated portion;

said horizontal flange continuously formed so that said cover may be latched in any rotational orientation; and said tabs spaced from one another so that said horizontal flange cannot inadvertently slip out from under said tabs.

8. A pastry container assembly as defined in claim 7 wherein:

said tabs each extend along less than fifteen degrees of arc along the circumference of said tray and are equally spaced along the tray circumference.

9. A pastry container assembly as defined in claim 7 further comprising three of said horizontal tabs spaced at 120-degree intervals.

10. A pastry container assembly as defined in claim 7 comprising one of said tabs extending along 120 degrees of arc of the circumference of said tray.

11. A pastry container comprising:

a cake tray;

a cover resting on said cake tray;

a cake plate having its bottom surface resting on the top surface of said tray; and mutually registering means formed in said top and bottom surfaces for preventing said plate from moving transversely with respect to said tray.

12. A pastry container comprising:

a cake tray;

a cake plate having its bottom surface resting on the top surface of said tray; and first means formed in one of said top and bottom surfaces protruding from said one surface; and second means formed in the other of said surfaces receiving said first means for resisting relative movement between said plate and said tray even when said tray is tilted to a substantial angle.

13. A pastry container assembly comprising:

an integrally formed thin plate for mounting a pastry, said plate having a nearly uniform thickness throughout so that its top and bottom surfaces have congruent surface features;

an integrally formed thin container tray having a nearly uniform thickness throughout so that its top and bottom surfaces have congruent surface features;

said said tray having an inner elevated circular portion supporting said plate, said elevated portion and said plate having nearly the same diameter, the top surfaces of said elevated portion and said plate mutually having congruently nested surface features, said surface features on each of said tray and plate comprising:

a plurality of radially extending lands each having an arcuately convex top surface;

a plurality of radially extending grooves between adjacent ones of said lands, each of said grooves having an arcuately concave top surface;

an inner recess centrally located with respect to said lands and grooves said lands and grooves converging at said recess; and an outer annular groove surrounding said lands and grooves; and a raised annular surface surrounding said annular groove;

said tray also comprising a circumferential elevated annulus formed along the outer circumference of said tray having a flat top surface, said elevated annulus and said elevated inner circular plate supporting portion defining an intermediate annular groove therebetween;

said tray having cover fastening means comprising:

a vertically upwardly extending outer circumferential flange located along the outer circumference of said tray; and a plurality of integrally formed resiliently deformable horizontally extending tabs disposed radially inwardly on the inner surface of said flange, the top surfaces of said tabs comprising a ramped portion extending continuously from near the top edge of said vertical flange to the radially inner edge of each of said tabs; and a container cover fastened on top of said tray, comprising:

a hollow dome-shaped member having an open bottom and a covered top, the radius of said cover open bottom approximating the inner diameter of said tray elevated annulus; and a resiliently deformable horizontal annular flange extending radially outward from the lower edge of said cover, the outer diameter of said horizontal flange approximating the diameter defined by said circumferential vertical flange on said tray, said cover supported by its horizontal flange resting o said elevated annulus, said plurality of tabs disposed along said vertical flange so that said horizontal flange is deformably receivable over said ramped surfaces to be latched between said elevated annulus and said tabs.

* * * * *